US006325219B1

(12) United States Patent
Schild

(10) Patent No.: US 6,325,219 B1
(45) Date of Patent: Dec. 4, 2001

(54) DEVICE FOR BURGLAR-PROOF PRESENTATION OF ITEMS

(76) Inventor: Beat Schild, Rottmannsbodenstrasse 131, Binningen CH-4102 (CH)

( * ) Notice: Subject to any disclaimer, the term of this patent is extended or adjusted under 35 U.S.C. 154(b) by 0 days.

(21) Appl. No.: 09/581,277

(22) PCT Filed: Dec. 8, 1998

(86) PCT No.: PCT/CH98/00518

§ 371 Date: Aug. 17, 2000

§ 102(e) Date: Aug. 17, 2000

(87) PCT Pub. No.: WO99/29215

PCT Pub. Date: Jun. 17, 1999

(30) Foreign Application Priority Data

Dec. 9, 1997 (CH) ..... 2840/97
May 5, 1998 (CH) ..... 1005/98

(51) Int. Cl.[7] ..... A47F 5/00
(52) U.S. Cl. ..... 211/8; 211/4; 70/58; 70/62
(58) Field of Search ..... 211/4, 7, 8; 70/58, 70/59, 62

(56) References Cited

U.S. PATENT DOCUMENTS 2,953,251 * 9/1960 Stone et al. .
3,400,812 9/1968 Snow .
3,690,130 9/1972 Eutzler .
3,827,569 8/1974 Canning .
4,088,228 5/1978 Schwalbe .
4,300,690 * 11/1981 Thomas ..... 211/4
4,540,092 * 9/1985 DeSantis ..... 211/4
5,022,534 6/1991 Briggs .
5,103,984 4/1992 Leyden et al. .
5,160,048 * 11/1992 Leyden et al. ..... 211/7
5,823,358 * 10/1998 Leyden et al. ..... 211/8

FOREIGN PATENT DOCUMENTS 296 22 953 U1 10/1997 (DE) .
2 473 096 7/1981 (FR) .
2 668 197 4/1992 (FR) .

OTHER PUBLICATIONS

Derwent English language abstract of DE 296 22 953 U1 (document B1).
Derwent English language abstract of FR 2 473 096 (document B2).
Derwent English language abstract of FR 2 668 197 (document B3).

* cited by examiner

*Primary Examiner*—Robert W. Gibson, Jr.
(74) *Attorney, Agent, or Firm*—Bryan Cave, LLP

(57) ABSTRACT

An anti-theft device for displaying merchandise has hangers for hanging up the merchandise. The hangers are provided with retaining means for preventing the merchandise from being removed from the hanger and with hooks with which the hangers are hooked in holes drilled in the main support. The main support has a lockable rail covering the hangers hooked in to the main support for preventing the hangers from being unhooked.

5 Claims, 3 Drawing Sheets

DEVICE FOR BURGLAR-PROOF PRESENTATION OF ITEMS

The invention relates to an anti-theft device for displaying merchandise, comprising hangers for hanging up the merchandise, which at one end are provided with retaining means for preventing the merchandise from being removed from the hanger, and which at the other end, where the merchandise is put on and taken off, have hooking means, and comprising a main support with recesses where the hooking means of the hangers are hooked in, and a lockable obstruction on the main support for preventing the hangers from being unhooked.

Many items of merchandise have mutually conflicting requirements, namely on the one hand the vendor's interest in a customer-friendly display which affords the potential customer the possibility of examining the merchandise thoroughly, and on the other hand the need to secure the merchandise against theft, which would require the merchandise to be locked up and would not be customer-friendly.

To make theft at least more difficult and, if desired, to be able unambiguously to identify the stolen goods as such, the merchandise is often individually provided with an anti-theft device which cannot be removed from the merchandise without a special tool.

DE-A-36 08 695 discloses an anti-theft device for belts, in which an individual belt is hooked in and bolted by its buckle. If one wanted to steal the belt, the device would have to be taken with it. This would attract more attention than taking a belt without such a device.

FR-A-2 535 594 and FR-A-2 546 390 disclose anti-theft devices for wallets and the like based, on the same princple.

U.S. Pat. No. 4,088,228 discloses an anti-theft device for displaying articles of clothing. Hangers, on which the merchandise hangs, are inserted from above into a support inside which a locking bar runs, said bar interacting with the appropriately shaped, inserted ends of the hangers.

All these security means make theft more difficult to a degree, but they offer no real security, or they are so elaborate and expensive that they are not viable for merchandise in lower and medium price brackets.

The object of the present invention is therefore to provide an anti-theft device for merchandise which on the one hand allows the customer-friendly, open display of the merchandise, and on the other hand offers the greatest possible security against theft of the merchandise, and which can be produced at reasonable cost.

According to the invention, this is achieved by a device of the type mentioned at the outset in which the recesses consist of holes drilled in the main support, and the obstruction takes the form of a rail covering the hangers which have been hooked in.

Preferred embodiments of the invention are described below with the aid of the attached drawings, in which.

Figure 4:
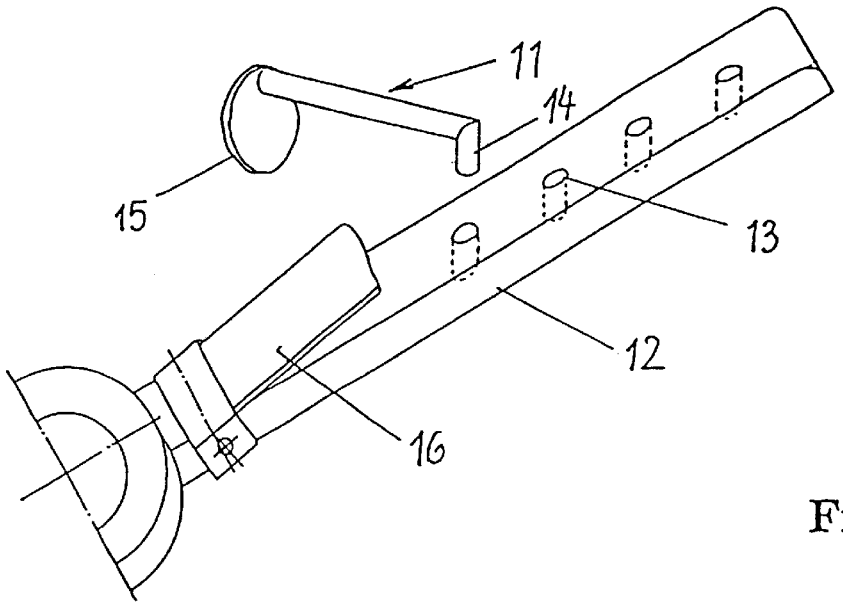
Figure 5:
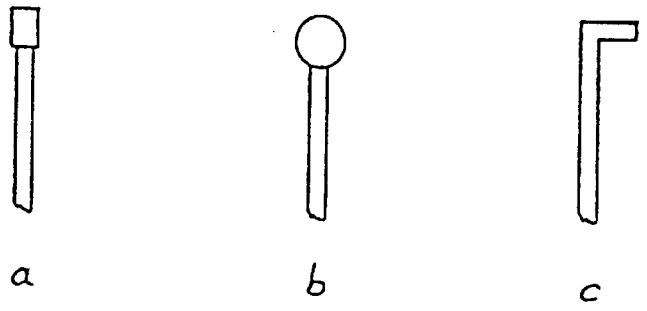
Figure 6:
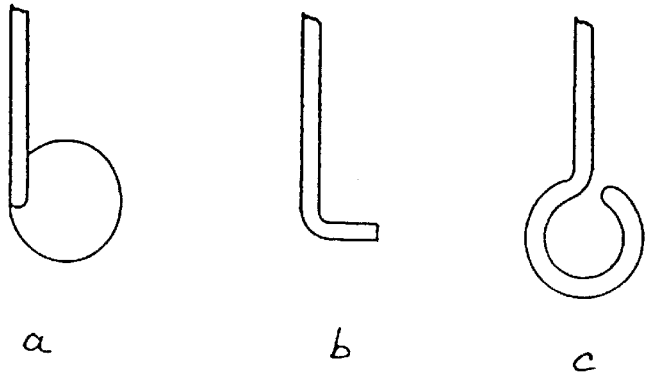

FIGS. 3*a*–3*g* show different shapes of hanger;

FIG. 4 is a representation in perspective of an alternative form of device for displaying merchandise;

FIGS. 5*a*–5*c* show different shapes of hanger ends for hooking into the main support; and FIGS. 6*a*–6*c* show different shapes of buffer for the merchandise which is hanging up.

Figure 1:
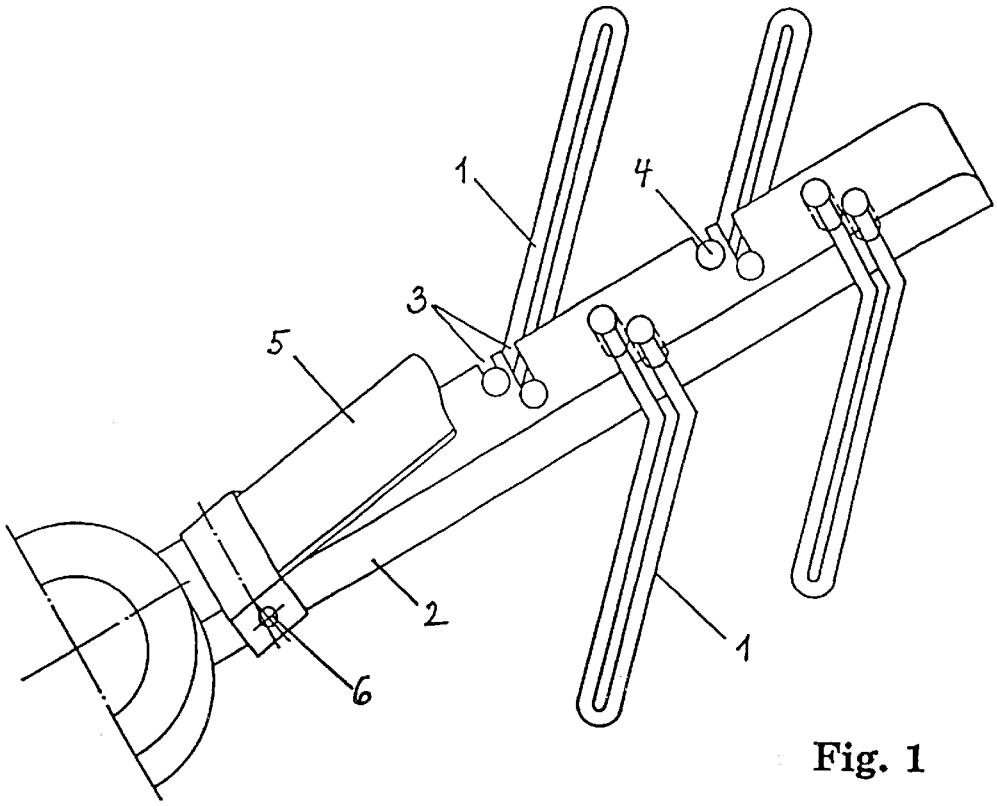
FIG. 1 is a representation in perspective of a device for displaying wallets.
Figure 2:
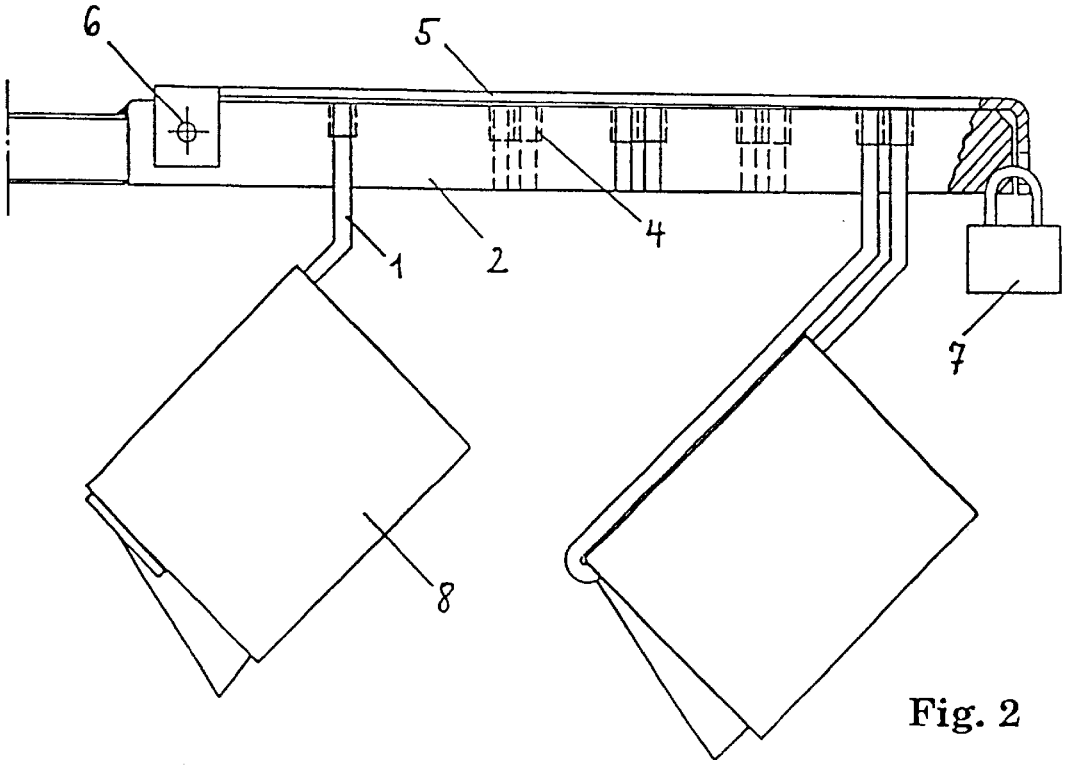
FIG. 2 is a side view of the same device.

The device shown in FIGS. 1 and 2 consists of hangers 1 hooked into a main support 2. The hangers 1 are essentially U-shaped, the legs being bent at an angle of approx. 45°. The main support 2 has a number of pairs of slots 3 corresponding to the number of hangers. The width of the slots corresponds to the thickness of the hangers and, at their inner ends, the slots have an enlargement whose diameter and depth correspond to a bulge 4 at the ends of the hangers 1. The hangers 1 are inserted into the slots from the side and, at the end with the bulge, are pushed down into the enlargement.

The two slots of a pair extend different distances inwards from the side wall of the main support so that the enlargements, and hence the ends of the inserted hangers, are located on a line running skew relative to the longitudinal axis of the main support. In this position the hangers thus hang skew relative to the main support and can be rotated through a certain angle.

The main support is provided with an obstruction consisting of a rail 5, which at one end is fixed with an upward-folding hinge 6 and at the other end can be obstructed with a lock 7. When the obstruction is locked, the hangers cannot be lifted up or, consequently, removed from the holder in the main support.

Instead of using the obstruction to prevent the hangers from being lifted up, an alternative method is to use a rotating or folding rail to obstruct sideways removal from the slot. The obstruction can also have a sliding bar rather than a rotating or folding rail.

Locking is effected either by means of a padlock through face holes in the main support and in the obstruction, as in the example shown, or by means of a lock built into the main support, the rail or the bar of the obstruction hooking into said lock.

FIG. 2 shows how the merchandise, in the present case the wallets 8, hang on the hangers. The hangers are first passed through the wallet with one leg on the inside of the back of the wallet, and then inserted into the main support and obstructed. The customer can rotate and open each individual wallet displayed in this way and thus look at it from all sides, as well as from inside, without being able to remove it.

Figure 3:
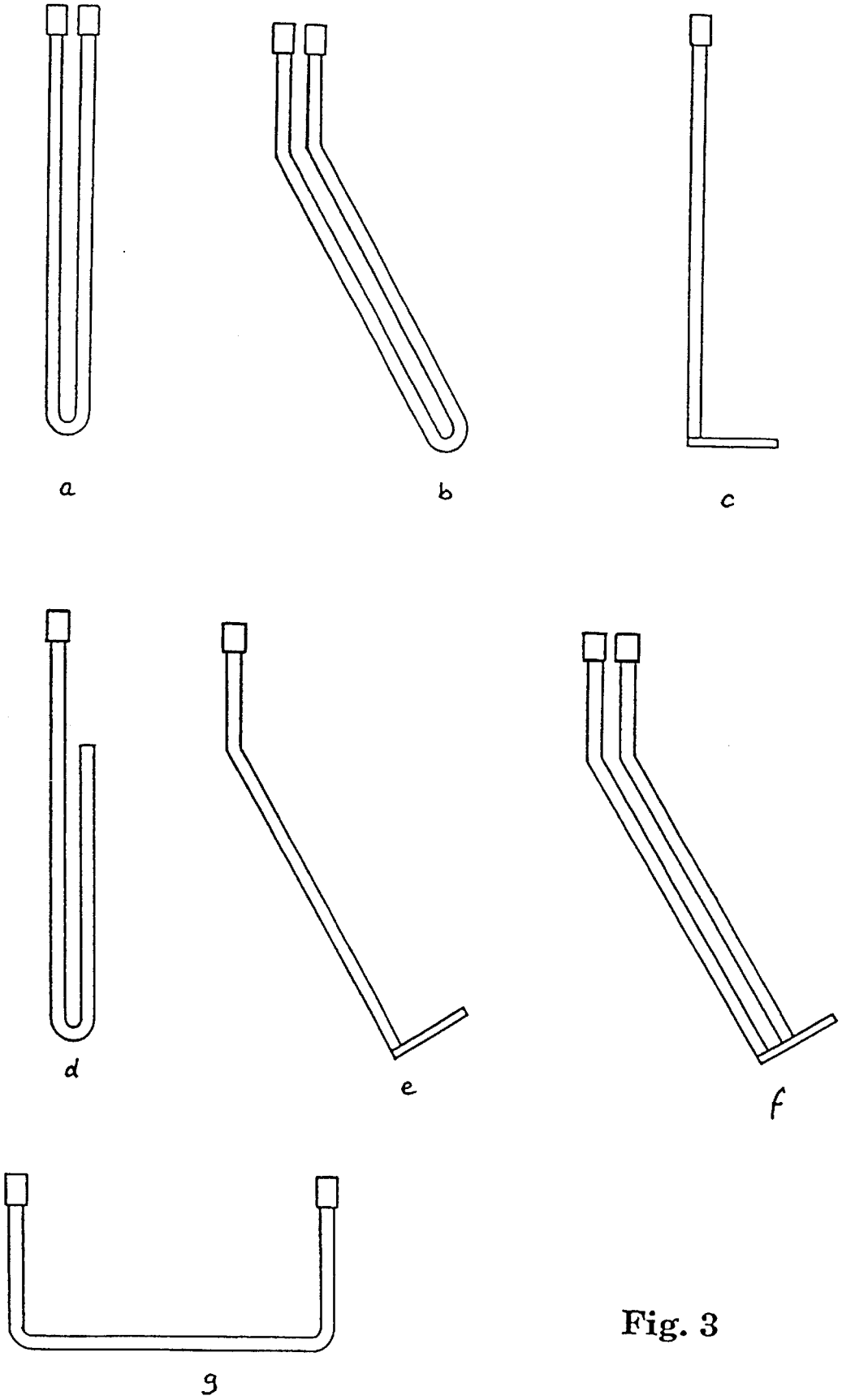

As shown in FIGS. 3*a*–*g*, hangers can have shapes other than the U-shape illustrated in FIG. 1. FIG. 3*a* shows a straight U-shaped hanger which points perpendicularly downwards when inserted. FIG. 3*b* shows a U-shaped hanger which is also bent but relative to an axis perpendicular to the plane defined by the legs of the hanger. FIG. 3*c* shows a simple straight hanger with a buffer at the end. The buffer is large enough to prevent the merchandise from being removed at this end of the hanger. Simple hangers are less expensive than U-shaped ones, but the latter are more robust. FIG. 3*d* shows a U-shaped hanger with legs of unequal length where only one leg hooks into the main support. FIG. 3*e* shows a simple bent hanger with a buffer at the end. FIG. 3*f* shows an angled hanger with two legs which has a buffer instead of the U-shape. FIG. 3*g* shows a wide hanger for hooking into slots which are further apart. This hanger is used to display merchandise which is larger or of a different shape.

The device shown in FIG. 4 for displaying merchandise, for example wallets again, is a simpler embodiment in which the hangers 11 are not hooked into slots but inserted from above into an appropriately designed main support 12. The main support 12 is provided with a row of drilled holes 13 into which L-shaped hangers 11 are inserted by their short legs 14. The hangers are provided at their other ends with buffers 15. As in the embodiment already described, the main support is provided with an obstructing rail 16 which, when folded down, prevents the hangers from being removed.

As shown in FIGS. 5*a–c*, the bulges by which the hangers are held in the main support can have a variety of shapes. FIG. 5*a* shows the end of a hanger with a loop pushed over it. FIG. 5*b* shows the end of a hanger with a ball soldered onto it. FIG. 5*c* shows the simply angled end of a hanger like that of the embodiment in FIG. 4.

FIGS. 6*a–c* show different shapes of buffer at the ends opposite the main support. FIG. 6*a* shows a plate attached to the end. This can be round, but may also have corners. FIG. 6*b* shows the simply angled end of a hanger. FIG. 6*c* shows the end of a hanger which has been bent in a circle. The buffer serves on the one hand as an enlarged bearing surface for the merchandise so that the latter suffers less wear. The buffer serves on the other hand to bring the merchandise back into an ordered state more easily when it has been left in disarray by an observer.

What is claimed is:

1. An anti-theft device for displaying merchandise, comprising hangers for hanging up the merchandise, comprising a first end comprising a retaining means for preventing the merchandise from being removed from the hanger, and a second end, comprising a hooking means, and the anti-theft device further comprising a main support with recesses where the hooking means of the hangers is hooked in to the main support, and a lockable obstruction on the main support for preventing the hangers from being unhooked, wherein the obstruction is a rail covering the hangers which have been hooked in.

2. The anti-theft device according to claim 1, wherein the rail is foldable over the main support.

3. The anti-theft device according to claim 1, wherein the recesses are holes drilled in the main support having a cylindrical cross-section.

4. The anti-theft device according to claim 1, wherein the recesses are connected by slots to a side face of the main support.

5. The anti-theft device according to claim 1, wherein the main support further comprises a means for locking the rail.

* * * * *